US009013501B2

(12) United States Patent
Scheibe

(10) Patent No.: US 9,013,501 B2
(45) Date of Patent: Apr. 21, 2015

(54) TRANSMISSION CHANNEL FOR IMAGE DATA

(75) Inventor: Paul O. Scheibe, Arroyo Grande, CA (US)

(73) Assignee: Landmark Screens, LLC, Palo Alto, CA (US)

( * ) Notice: Subject to any disclaimer, the term of this patent is extended or adjusted under 35 U.S.C. 154(b) by 1104 days.

(21) Appl. No.: 12/611,010

(22) Filed: Nov. 2, 2009

(65) Prior Publication Data

US 2011/0102472 A1 May 5, 2011

(51) Int. Cl.
*G09G 5/02* (2006.01)
*G09G 5/04* (2006.01)

(52) U.S. Cl.
CPC .. *G09G 5/02* (2013.01); *G09G 5/04* (2013.01); *G09G 2340/06* (2013.01)

(58) Field of Classification Search
USPC ..... 345/600–605; 382/166, 232–253
See application file for complete search history.

(56) References Cited

U.S. PATENT DOCUMENTS

2005/0276502 A1* 12/2005 Brown Elliott et al. ..... 382/254
2006/0197777 A1* 9/2006 Cha et al. ..... 345/600
2008/0252797 A1* 10/2008 Hamer et al. ..... 348/802
2009/0040152 A1 2/2009 Scheibe

* cited by examiner

*Primary Examiner* — Phi Hoang
*Assistant Examiner* — Mohammad H Akhavannik
(74) *Attorney, Agent, or Firm* — Edward C. Kwok; Steven P. Chen; Hogan Lovells US LLP

(57) ABSTRACT

A display controller having only three color channels per pixel is used to control a display system having four or more color channels. Mapping of the possible luminance values for each color channel of each pixel to the $2^n$ intervals represented by the n bits in each color channel are provided according to a function that is based on human color perception, so as not to generate artifacts.

34 Claims, 3 Drawing Sheets

EXAMPLE MODEL – SHOWS SEQUENCE OF TRANSFORMATIONS AND QUANTIZERS USED TO EFFECTIVELY USE TRANSMISSION MEDIUM.

EXAMPLE MODEL – SHOWS SEQUENCE OF TRANSFORMATIONS AND QUANTIZERS USED TO EFFECTIVELY USE TRANSMISSION MEDIUM.

COLOR SAMPLES IN GAMUT - DOTS ARE AT THE COORDINATES OF COLORS THAT ARE SAMPLED TO EVALUATE THE TRANSMISSION ERROR.

HISTOGRAM OF CIE $\Delta E$ – NOTE THAT THE MAXIMUM ERROR SATISFIES $\Delta E<1$.

TRANSMISSION CHANNEL FOR IMAGE DATA

BACKGROUND OF THE INVENTION

1. Field of the Invention

The present invention relates to a method for transmitting video data intended for an light emitting diode (LED) display unit having LEDs of four or more color channels, using a conventional LED display controller having only three color channels.

2. Discussion of the Related Art

LEDs are used to form the picture elements ("pixels") that display the images shown on modern advertising structures, such as electronic signboards. In a typical electronic signboard, each pixel is formed by three or more separately controlled basis colors ("color channels"), with each color channel of the pixel being implemented by several LEDs. The LEDs in a color channel may be serially connected. Therefore, the LEDs deployed to produce the multicolored images number in from hundreds of thousands to millions. By properly controlling the intensity of light emitted from each color channel, it is possible to produce light of a wide variety of colors and intensities at each pixel.

In a conventional LED, the emitted light intensity at any time is a function of the average electrical current through the LED over a short time period immediately before that instance in time. Any possible color and brightness can be achieved by precise adjustment of the average current in each color channel.

To display an image, digital data specifying the intensities of the color channels of each pixel is downloaded from a data source to the electronic signboard. The downloaded digital data is usually temporarily stored in a display controller or "player," which repetitively plays the data on the electronic signboard in the form of a sequence of images.

Until recently, electronic signboards are formed by pixels having only three color channels. Thus, most commercially available players for such an electronic signboard support only three color channels per pixel and, most often, each color channel is specified by 8 bits. Therefore, to support more than three color channels, the downloaded digital data are typically played using a multiplexing technique. However, in such a player, as each color channel is limited to eight bits, the bits are carefully allocated to avoid introducing artifacts in the resulting image displayed on the electronic signboard.

SUMMARY

According to one embodiment of the present invention, a display controller having only three color channels per pixel, with each color channel having a limited resolution of n bits, is used to control a display system having four or more color channels. Mapping of the possible luminance values for each color channel of each pixel to the $2^n$ intervals represented by the n bits in each color channel is provided according to a function that is based on human color perception, so as not to generate artifacts.

The present invention is better understood upon consideration of the drawings in conjunction with the accompanying drawings.

BRIEF DESCRIPTION OF THE DRAWINGS

FIG. 3 shows the relative frequency of occurrence as a function of error size, using a 5-color channel system and the transformations and inverse transformations according to one embodiment of the present invention, with 8-bit quantization for transmission through the medium and 16-bit quantization for driving a display unit.

DETAILED DESCRIPTION OF THE PREFERRED EMBODIMENTS

A method according to the present invention takes advantage of one or more analytical models of the relation between tristimulus values[1] and what is perceived by the human observer. The method also limits any error in transmission over the limited color channels of a conventional 3-color 8-bit channel player to less than that perceptible by the human observer. A "uniform color space" (e.g., CIE L*a*b* color space) provides a way to quantify the perceived error. In this detailed description, the CIE L*a*b* color space is used for convenience, but other uniform color spaces may be used within the scope of the method. The present invention is not limited by any particular color representation, and may in fact be carried out using any suitable color representation. For example, instead of CIE L*a*b* color space, the CIE L*u*v* color space may also be used.

[1]The tristimulus value refers to the representation of a color using three numerical values. One example of a tristimulus value is the "uniform color space" CIE L*a*b* color space representation, which is well-known to those skilled in the art. Under that representation, for example, the tristimulus value is specified by one luminance value and two chrominance values. See, for example, Gunter Wyszecki and W. S. Stiles, *Color Science Concepts and Methods, Quantitative Data and Formulae, 2nd Edition*, John Wiley & Sons, Inc., New York (1982), pp. 130-248, esp. 137-142, 166-168, for a discussion of the CIE colorimetric system. The CIE L*a*b* "uniform color space" is widely used to evaluate color and luminance differences.

Figure 1:
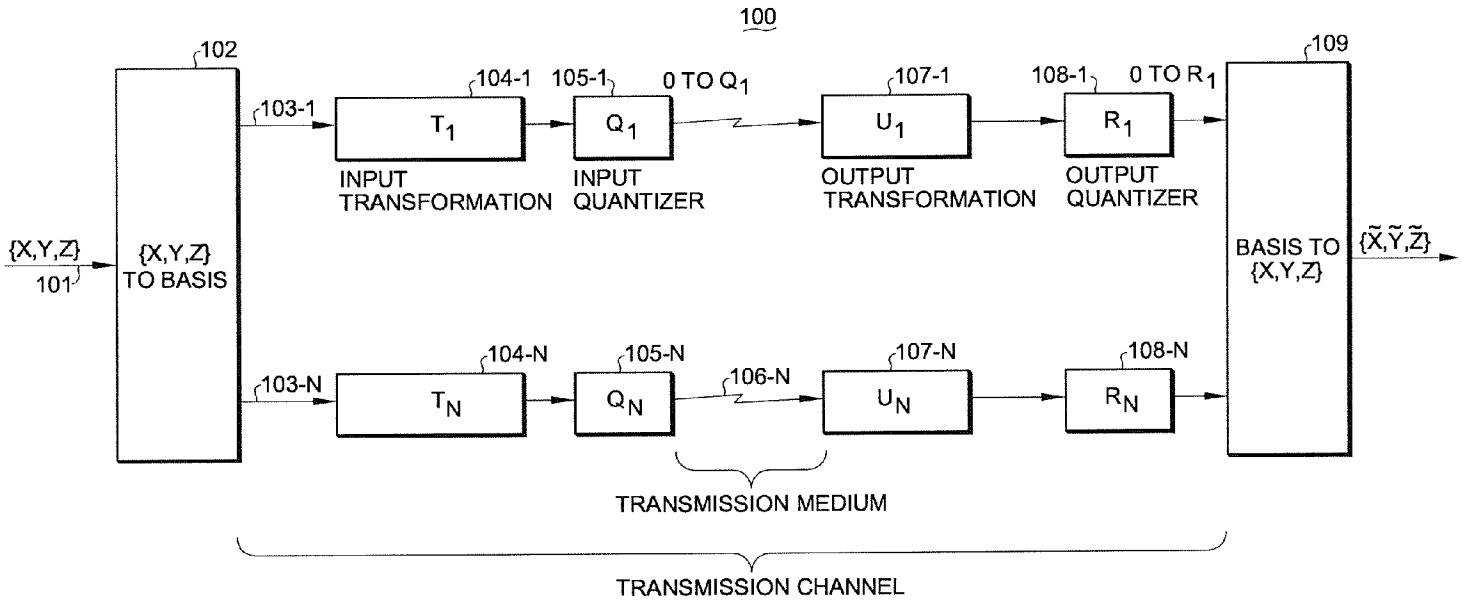
FIG. 1 illustrates method 100 for driving a display unit of more than 3 color channels using a conventional 3-color channel player of limited resolution, according to one embodiment of the present invention.

FIG. 1 illustrates method 100 for driving a display unit of more than 3 color channels using a conventional 3-color channel player of limited resolution, according to one embodiment of the present invention. As shown in FIG. 1, to display a desired color (X, Y, Z) using more than three color channels (say N color channels, N being an integer), the desired pixel color (e.g., color input value 101, described by the tristimulus CIE colorimetric system (XYZ coordinates)) is mapped at mapper 102 to a luminance value $Y_i$ in the corresponding i-th color channel of the pixel. In this example, the i-th color channel corresponds to a basis color having a maximum luminance value $Y_{max,i}$ and chrominance values ($x_i$, $y_i$). Mapper 102 may provide such a mapping using a method based on linear programming or another programming algorithm, such as described, for example, in the present inventor's U.S. patent application Ser. No. 11/836,116, entitled "GRAPHICAL DISPLAY COMPRISING A PLURALITY OF MODULES EACH CONTROLLING A GROUP OF PIXELS CORRESPONDING TO A PORTION OF THE GRAPHICAL DISPLAY," which was filed on Aug. 8, 2007. Given a desired color specified by the tristimulus, mapper 102 provides output values 103-1 to 103-N—possibly, each a floating point number or an integer. Method 100 then provides a set of transformations (T) 104-1 to 104-N, transforming the respective drive values for the corresponding color channels to a set of intermediate values. As discussed in further detail below, transformations 104-1 to 104-N are based on a transformation function designed to take advantage of the fact that human color perception for a given color is non-linear over the wide range of luminance suitable for viewing. A suitable function for transformations 104-1 to 104-N maps the selected range of drive values monotonically to a corresponding range of output values.

Transformations 104-1 to 104-N may be realized in many different ways (e.g., in software, hardware or by a look-up table), the intermediate values are quantized by q-bit quantizations 105-1 to 105-N to the specified resolution of q bits supported by the color channels. In this example, for use in a conventional 3-color play, q-bit is 8-bits. Note that, in some implementations, the transformation and quantization steps may be combined. For example, in a look-up table implementation, the output values of mapper 102 may be used to access a memory location containing the corresponding quantized intermediate values (e.g., TIFF Lab format values), without a separate quantization step.

The quantized intermediate values 106-1 to 106-2 are transmitted by the conventional player as a sequence of 8-bit words over its 3 color channels, as if it is a sequence of conventional pixel values suitable for driving a convention 3-color display unit. The transmitted 8-bit words may include, in addition to the quantized intermediate values, other parameter values that may be suitably utilized at the display unit, if desired.

At the display unit, the transmitted values 106-1 to 106-N are received by the display unit and the output values 103-1 to 103-N are recovered using inverse transformations (U) 107-1 to 107-N. Inverse transformations 107-1 to 107-N need not be mathematically exact inverse functions of transformations 104-1 to 104-N, suitable inverse functions need only recover the output values to within acceptable error bounds ("approximate inverse function"). Like transformations 104-1 to 104-N, inverse transformation 107-1 to 107-N may be realized in many different ways (e.g., in software, hardware or by a look-up table). The output values of inverse transformations 107-1 to 107-N are then quantized by r-bit quantizations 108-1 to 108-N—r bits being the expected resolution of the LED drive electronics—and provided to the LED drive electronics at the expected resolution. In this example, the value of r may be, for example, 16. As shown in FIG. 1, LED drive electronics 109 display the received color ($\tilde{X}$, $\tilde{Y}$, $\tilde{Z}$) at the pixel.

Transformations 104-1 to 104-N and inverse transformation 107-1 to 107-N are designed to take advantage that human color perception response for a given color is non-linear over the wide range of expected luminance. For example, the following inverse transformation (U) allows a greater change in luminance per unit change at the greater quantized intermediate values, and a lesser change in luminance per unit change at the lesser quantized intermediate values:

$$U(x) = \begin{cases} C(x+\beta)^{\alpha}, & \text{for } x \geq x_0 \\ \gamma x, & \text{for } x < x_0 \end{cases}$$

Where C, $x_0$ and $\alpha$ are model parameters, with $\beta$ and $\gamma$ selected such that U(x) and its first derivative are both continuous at $x=x_0$. One solution provides $\beta=(\alpha-1)x_0$ and $\gamma=C\alpha^{\alpha}x_0^{\alpha-1}$. If it is desired that $U(x_{max})=U_{max}$, then $$C = \frac{U_{max}}{(x_{max} + (\alpha - 1)x_0)^{\alpha}}.$$

The corresponding transformation T(x) may be derived by inverting inverse transformation U(x).

Figure 2:
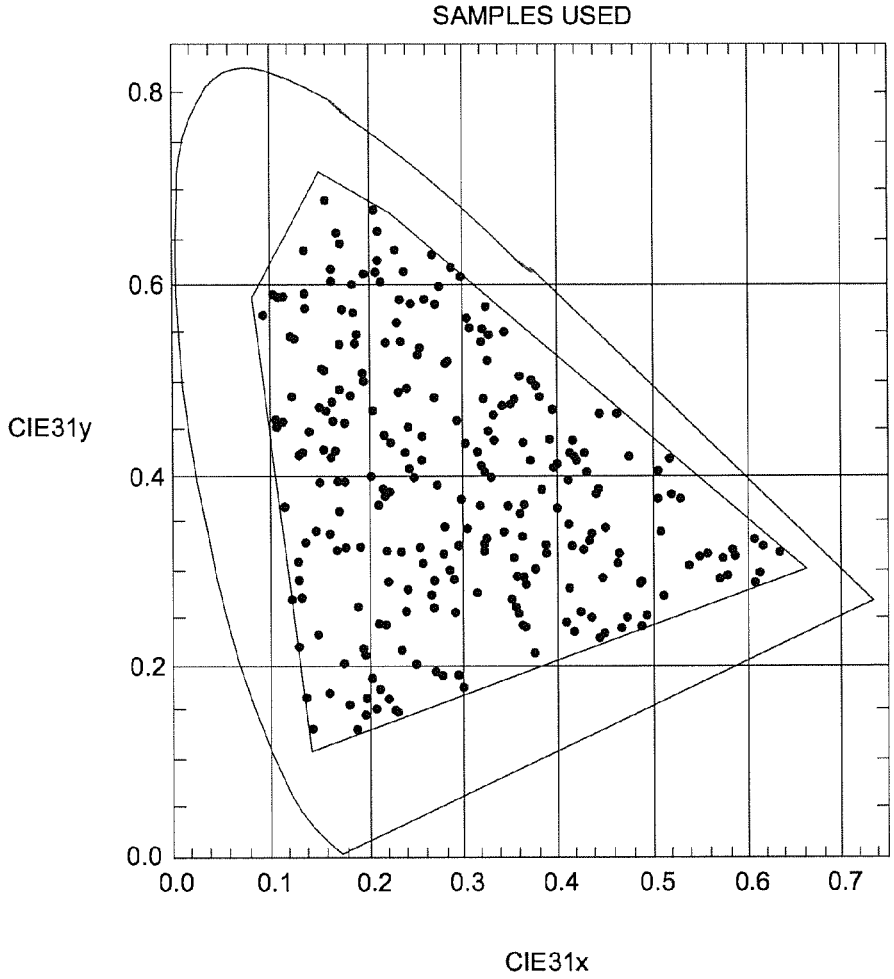
FIG. 2 shows a random set of colors that were generated to evaluate the performance of the method of FIG. 1.
Figure 3:
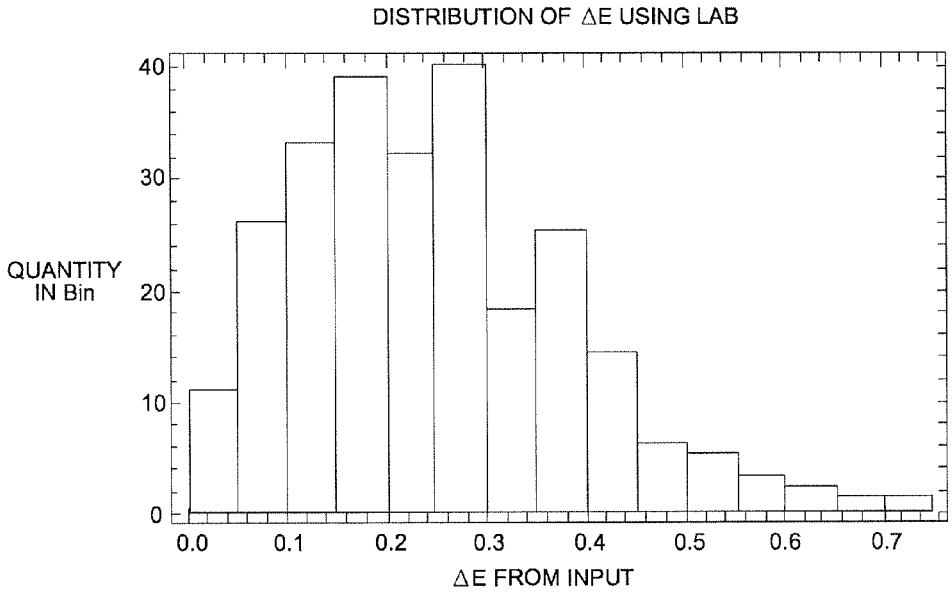
FIG. 3 is a histogram obtained in a performance evaluation of the method of FIG. 1, using the colors of FIG. 2.

FIG. 2 shows a random set of colors that were generated to evaluate the performance of the method of FIG. 1. FIG. 3 is a histogram obtained in a performance evaluation of the method of FIG. 1, using the colors of FIG. 2. FIG. 3 shows the relative frequency of occurrence as a function of error size, using a 5-color channel system and the transformations and inverse transformation discussed above, with 8-bit quantization for transmission through the medium and 16-bit quantization for driving the display unit.

The above detailed description is provided to illustrate specific embodiments of the present invention and is not intended to be limiting. Numerous variations and modifications within the scope of the present invention are possible. For example, although the detailed description above provides that each transformation function operates on a single output value of mapper 102, the present invention is not so limited. A transformation function that maps more than one output value of mapper 102 may also be possible. Further, any of the input or output values of the transformation functions or inverse transformation functions need not be a binary value. Such values may be represented using a multi-level digital representation or an analog representation. The present invention is set forth in the accompanying claims.

I claim:

1. A method for driving a display unit having more than three color channels per pixel, comprising:

mapping a desired color to a set of luminance values, each luminance value being provided for a corresponding one of the color channels;

transforming the luminance values to intermediate values at a first resolution that has a limited resolution compared to a resolution of drive values required for driving the color channels of the display unit according to transformation functions selected based on a model for human color perception response that is non-linear over the range of the luminance values, wherein one or more of the transformation functions is non-linear to provide different amounts of changes in the intermediate values per unit change in the luminance value at different values of the luminance values; and transmitting the intermediate values over the transmission medium to the display unit having more than three color channels as if the intermediate values are a sequence of pixel values for driving a display having fewer color channels at the first resolution, wherein the intermediate values are received by a receiver capable of recovering and providing the luminance values for the more than three color channels to the display unit.

2. A method as in claim 1, wherein one of the transformation functions maps more than one luminance value to one or more intermediate values.

3. A method as in claim 1, wherein said transforming the luminance values further comprises quantizing the intermediate values to the first resolution.

4. A method as in claim 3, wherein the first resolution is 8 bits.

5. A method as in claim 1, wherein the receiver recovers the luminance values by applying a function that is based on an inverse function of a corresponding transformation function.

6. A method as in claim 5, wherein the inverse function is given by:

$$U(x) = \begin{cases} C(x+\beta)^{\alpha}, & \text{for } x \geq x_0 \\ \gamma x, & \text{for } x < x_0 \end{cases}$$

where C, $x_0$ and $\alpha$ are parameters of the model, with $\beta$ and $\gamma$ selected such that U(x) and its first derivative are both continuous at $x=x_0$.

7. A method as in claim 5, wherein the inverse transformation function is an approximate inverse function of the transformation function.

8. A method as in claim 1, wherein the receiver provides the luminance values to drive electronics of the display unit quantized to a second resolution.

9. A method as in claim 8, wherein the second resolution is 16 bits.

10. A method for driving a display unit having more than three color channels per pixel, comprising:

receiving from a transmission medium by the display unit having more than three color channels a stream of intermediate values quantized to a first resolution as if the intermediate values are a sequence of pixel values for driving a display having fewer color channels, wherein the first resolution has a limited resolution compared to a resolution of drive values required for driving the color channels of the display unit, each intermediate value being a result of transforming one or more luminance values of corresponding color channels to the first resolution according to transformation functions selected based on a model for human color perception response that is non-linear over the range of the luminance values, wherein one or more of the transformation functions is non-linear to map to different amounts of changes in the intermediate values per unit change in the luminance value at different values of the luminance values;

recovering from the intermediate values a set of recovered luminance values, each recovered luminance value being provided for a corresponding one of the more than three color channels; and providing the recovered luminance values to the display unit.

11. A method as in claim 10, wherein one of the transformation functions maps more than one luminance value to one or more intermediate values.

12. A method as in claim 10, wherein the first resolution is 8 bits.

13. A method as in claim 10, wherein the recovered luminance values are recovered by applying a function that is based on an inverse function of a corresponding transformation function.

14. A method as in claim 13, wherein the inverse transformation function is an approximate inverse function of the transformation function.

15. A method as in claim 13, wherein the inverse function is given by:

$$U(x) = \begin{cases} C(x+\beta)^{\alpha}, & \text{for } x \geq x_0 \\ \gamma x, & \text{for } x < x_0 \end{cases}$$

where C, $x_0$ and $\alpha$ are parameters of the model, with $\beta$ and $\gamma$ selected such that U(x) and its first derivative are both continuous at $x=x_0$.

16. A method as in claim 10, wherein the recovered luminance values are quantized to a second resolution prior to being provided to the display unit to drive electronics in the display unit.

17. A method as in claim 16, wherein the second resolution is 16 bits.

18. A data source for driving a display unit having more than three color channels per pixel, comprising a processor and a memory coupled to the processor, wherein the memory stores instructions that when executed by the processor cause the data source to:

map a desired color to a set of luminance values, each luminance value being provided for a corresponding one of the color channels;

transform the luminance values to intermediate values at a first resolution that has a limited resolution compared to a resolution of drive values required for driving the color channels of the display unit according to transformation functions selected based on a model for human color perception response that is non-linear over the range of the luminance values, wherein one or more of the transformation functions is non-linear to map to different amounts of changes in the intermediate values per unit change in the luminance value at different values of the luminance values; and transmit the intermediate values over the transmission medium to the display unit having more than three color channels as if the intermediate values are a sequence of pixel values for driving a display having fewer color channels at the first resolution, wherein the intermediate values are received by a receiver capable of recovering and providing corresponding luminance values for the more than three color channels to the display unit.

19. A data source as in claim 18, wherein the processor further executes the instructions stored in the memory to quantize the intermediate values to the first resolution.

20. A data source as in claim 19, wherein the first resolution is 8 bits.

21. A data source as in claim 18, wherein one of the transformation functions maps more than one luminance value to one or more intermediate values.

22. A data source as in claim 18, wherein the receiver recovers the luminance values by applying a function that is based on an inverse function of a corresponding transformation function.

23. A data source as in claim 22, wherein the inverse transformation function is an approximate inverse function of the transformation function.

24. A data source as in claim 22, wherein the inverse function is given by:

$$U(x) = \begin{cases} C(x+\beta)^{\alpha}, & \text{for } x \geq x_0 \\ \gamma x, & \text{for } x < x_0 \end{cases}$$

where C, $x_0$ and $\alpha$ are parameters of the model, with $\beta$ and $\gamma$ selected such that U(x) and its first derivative are both continuous at $x=x_0$.

25. A data source as in claim 18, wherein the receiver provides the luminance values to drive electronics of the display unit quantized to a second resolution.

26. A data source as in claim 25, wherein the second resolution is 16 bits.

27. A driver for driving a display unit having more than three color channels per pixel, comprising a processor and a memory coupled to the processor, wherein the memory stores instructions that when executed by the processor cause the driver to:

receive from a transmission medium by the display unit having more than three color channels a stream of intermediate values quantized to a first resolution as if the intermediate values are a sequence of pixel values for driving a display having fewer color channels, wherein the first resolution has a limited resolution compared to a resolution of drive values required for driving the color channels of the display unit, the intermediate values resulting from transforming luminance values of the color channels to the first resolution according to transformation functions selected based on a model for human color perception response that is non-linear over the range of the luminance values, wherein one or more of the transformation functions is non-linear to map to different amounts of changes in the intermediate values per unit change in the luminance value at different values of the luminance values;

recover from the intermediate values a set of recovered luminance values, each recovered luminance value being provided for a corresponding one of the more than three color channels; and provide the recovered luminance values to the display unit.

28. A driver as in claim 27, wherein the first resolution is 8 bits.

29. A driver as in claim 27, wherein one of the transformation functions maps more than one luminance value to one or more intermediate values.

30. A driver as in claim 27, wherein the recovered luminance values are recovered by applying a function that is based on an inverse function of a corresponding transformation function.

31. A driver as in claim 30, wherein the inverse transformation function is an approximate inverse function of the transformation function.

32. A driver as in claim 30, wherein the inverse function is given by:

$$U(x) = \begin{cases} C(x+\beta)^{\alpha}, & \text{for } x \geq x_0 \\ \gamma x, & \text{for } x < x_0 \end{cases}$$

where C, $x_0$ and $\alpha$ are parameters of the model, with $\beta$ and $\gamma$ selected such that U(x) and its first derivative are both continuous at $x=x_0$.

33. A driver as in claim 27, wherein the recovered luminance values are quantized to a second resolution prior to being provided to the display unit to drive electronics in the display unit.

34. A driver as in claim 33, wherein the second resolution is 16 bits.

* * * * *